US005343983A

United States Patent [19]

Horvath et al.

[11] Patent Number: 5,343,983

[45] Date of Patent: Sep. 6, 1994

[54] THREAD BRAKE

[75] Inventors: Atila J. Horvath, Freudenstadt; Hermann Schmodde, Albstadt; Josef Fecker, Bisingen-Steinhofen, all of Fed. Rep. of Germany

[73] Assignee: Memminger-IRO GmbH, Dornstetten, Fed. Rep. of Germany

[21] Appl. No.: 930,656

[22] PCT Filed: Feb. 12, 1992

[86] PCT No.: PCT/DE92/00096

§ 371 Date: Sep. 30, 1992

§ 102(e) Date: Sep. 30, 1992

[87] PCT Pub. No.: WO92/14670

PCT Pub. Date: Sep. 3, 1992

[30] Foreign Application Priority Data

Feb. 15, 1991 [DE] Fed. Rep. of Germany ..... 4104663

[51] Int. Cl.[5] ..... B65H 59/16; D04B 35/32

[52] U.S. Cl. ..... 188/65.1; 66/146; 66/168; 242/150 R

[58] Field of Search ..... 188/64, 65.1, 65.2; 66/146, 158, 168; 242/150 R, 156

[56] References Cited

U.S. PATENT DOCUMENTS

| | | | |
|---|---|---|---|
| 3,991,954 | 11/1976 | Schwartz | 66/146 X |
| 4,202,511 | 5/1980 | Koslowski | 242/150 R |
| 4,209,881 | 7/1980 | Blore | 66/146 X |
| 4,313,578 | 2/1982 | Van Wilson et al. | 242/149 |

FOREIGN PATENT DOCUMENTS

| | | |
|---|---|---|
| 2758334 | 7/1979 | Fed. Rep. of Germany . |
| 3828762 | 3/1990 | Fed. Rep. of Germany . |

*Primary Examiner*—Robert J. Oberleitner
*Assistant Examiner*—Alfred Muratori
*Attorney, Agent, or Firm*—Frishauf, Holtz, Goodman & Woodward

[57] ABSTRACT

A thread brake with two disc shaped or plate shaped brake elements resiliently pressed against each other operates with an associated oscillation generating device to set the brake elements in oscillatory motions which are preferably oriented transversely to the bearing axis of the brake elements.

27 Claims, 14 Drawing Sheets

THREAD BRAKE

FIELD OF THE INVENTION

The invention relates to a thread brake with two preferably disc-shaped or plate shaped brake elements which are resiliently pressed against each other by load means and between which at least one thread to be braked can be led through. The brake elements are mounted on bearings having a common bearing axis and are acted upon by a device which sets them in oscillatory motions.

BACKGROUND

In such thread brakes which are widely used in practice, for example, in the form of so-called disc or plate brakes, the brake discs or plates forming the brake elements are usually rotatably mounted on a guide bolt having at one end a thread on which there is screwed an adjustment nut which forms the abutment of a compression spring which presses the two brake discs or plates elastically against each other. These have the inherent, fundamental disadvantage that lubricants (paraffins, bobbin oil etc.) adhering to the surface of the thread running off form deposits on the brake discs or plates and dirt particles and fluff settling in these produce a sticky, pasty mass which penetrates progressively between the brake discs or plates. In the course of time, these deposits which build up further and further during operation cause the brake discs or plates to be held apart, which makes them less and less able to exert their braking action on the thread passing through. An irregular braking effect also occurs and results in undesired fluctuations in the thread tension. In addition, the brake plates or discs are impeded in their moveability by this sticky mass, which causes the passing thread to start cutting into the brake surfaces of the brake plates or discs, a danger which is very pronounced particularly with synthetic threads. Once the braking surfaces are damaged to the extent that quite deep grooves or flutes are cut in them, the thread passing through also suffers damage.

These difficulties make it necessary for the thread brake to be cleaned and freed from undesired deposits or even exchanged altogether at certain time intervals.

To remedy this, it is known to make the brake discs or plates be driven via a gearing (German patent 27 58 334), but this involves relatively high expenditure and is only suitable in certain cases of use. Another known measure (German published patent application 30 29 509, German patent 29 30 641, to which U.S. Pat. No. 4,313,578, Van Wilson et al, corresponds) consists in using an ac-excited electromagnet instead of the conventional compression spring to press the two brake discs or plates against each other in the axial direction and simultaneously cause vibrations or oscillatory motions with twice the excitation frequency of the electromagnet to be imparted to the brake discs or plates consisting of magnetic material by the magnetic ac field. These oscillatory motions occur in the direction of the bearing axis and, independently of the oscillatory behaviour of the brake discs or plates, can result in non-uniform braking action on the thread passing through, which causes corresponding fluctuations in the thread tension. Also, in principle, such a thread brake is dependent upon an electric ac supply which, however, in many cases is not available.

THE INVENTION

It is an object of the invention to produce a thread brake which is distinguished by improved self-cleaning action, i.e., effectively prevents the occurrence of undesired deposits of lubricant etc. and simultaneously ensures uniform thread braking over long periods of operation.

Briefly, the brake elements can be set by the invention in that the brake elements can be set by the oscillation generating device in oscillatory motions which are oriented essentially transversely to the bearing axis.

Practical experience has shown that this measure not only ensures smooth working of the discs or plates over long operating times but does, in fact, effectively prevent buildup of undesired deposits.

In a preferred embodiment, the brake elements are mounted on an elongated guide element containing the bearing axis, with the brake elements being adapted to be set in oscillatory motions jointly with the guide element. In this case, the guide element can be of rigid design, for example, a cylindrical bolt. Embodiments are, however, also conceivable in which the guide element is at least in part elastic, which can be implemented by, for example, the guide element being made of an appropriate plastic material. Another alternative consists in mounting the guide element elastically in holding means so it receives the necessary moveability at its bearing point.

Particularly simple structural relations are obtained by the assembly being designed such that the guide element is connected to holding means and that the holding means can be set in oscillatory motions jointly with the guide element and the brake elements. This embodiment has the additional advantage that the settling of fluff on the holding means etc. is also prevented as these execute a vibratory motion which results in continuous "shaking off" of the deposit of fibre etc.

The brake elements themselves are advantageously mounted on the guide element with radial play so they can execute a certain motion independent of the guide element in the oscillating direction. Practical experience has, furthermore, shown that the conventional thread brakes of the kind in question it is expedient for the oscillatory motions to have a frequency of approximately 40 to 500 Hz.

Excitation of the oscillations of the brake elements can be brought about in many different ways. The design of the device used for this purpose depends, among other things, on the particular use of the thread brake and on the drive means available at the operating site. It has proven advantageous for the oscillation generating device to comprise a driven member which executes a reciprocating motion and is directly or indirectly coupled with the brake elements. In the embodiment of the thread brake mentioned hereinabove wherein the holding means execute the oscillatory motion jointly with the brake elements, the holding means can be directly mounted on the member executing the reciprocating motion, which results in further simplification of the structural relations.

When the new thread brake is used in connection with the supplying of thread to textile machines which use thread, for example, circular knitting machines, the thread brake can be arranged on a thread supplying device comprising a rotating shaft, with the member which executes the reciprocating motion being coupled with the shaft via a gearing which generates this motion. The rotating shaft of these thread supplying devices usually drives a thread supplying element, for example, in the form of a thread storage roll or a thread winding element. It itself is driven by a drive source which in the case of a circular knitting machine, in practice, often consists of an endless toothed belt with which the shafts of the individual thread supplying devices are each coupled via a toothed belt pulley and which, for its part, is synchronously rotated with the needle cylinder.

Under certain circumstances, embodiments of the thread brake are also advantageous in which the oscillation generating device is designed to act directly on the brake elements by, for example, engaging their circumference.

The gearing mentioned hereinabove can be a cam gear mechanism with a cam element seated on the shaft and with the reciprocating member held in contact with the cam surface thereof. All positive connection gearings which generate an oscillatory motion, for example, also eccentric gearings etc. are to be understood as "cam gear mechanism".

Various other modifications of the new thread brake are the subject matters of further subclaims.

DRAWINGS

Embodiments of the subject matter of the invention are illustrated in the appended drawings which show:

FIG. 1 a side view of a thread supplying device with a thread brake according to the invention;

FIG. 2 a plan view of the assembly according to FIG. 1;

FIG. 3 a side view of the thread brake of the assembly according to FIG. 1 in a partial illustration taken along line III—III of FIG. 1 on a different scale;

FIG. 4 an illustration of a modified embodiment of the assembly according to FIG. 3;

FIG. 5 an illustration of a modified embodiment of the assembly according to FIG. 4;

FIG. 6 a side view of a portion of the thread supplying device according to FIG. 1, with a modified embodiment of a thread brake according to the invention, FIG. 7 a plan view of the thread brake of the assembly according to FIG. 6, in a partial illustration taken along the line VII—VII of FIG. 6, on a different scale, FIG. 8 a side view of a modified embodiment of the thread brake of the assembly according to FIG. 6, FIG. 9 a side view of a further modified embodiment of the thread brake of the assembly according to FIG. 6, FIG. 10 a side view of a third modified embodiment of the thread brake of the assembly according to FIG. 6, FIG. 11 a side view taken from the backside of the thread brake according to FIG. 10, FIG. 12 a side view of a fourth modified embodiment of the thread brake of the assembly according to FIG. 6, FIG. 13 a side view taken from the backside of the thread brake according to FIG. 12, and FIG. 14 a plan view of the thread brake of FIG. 13, taken along the line XIV—XIV of FIG. 13, on a different scale.

DETAILED DESCRIPTION

Figure 1:
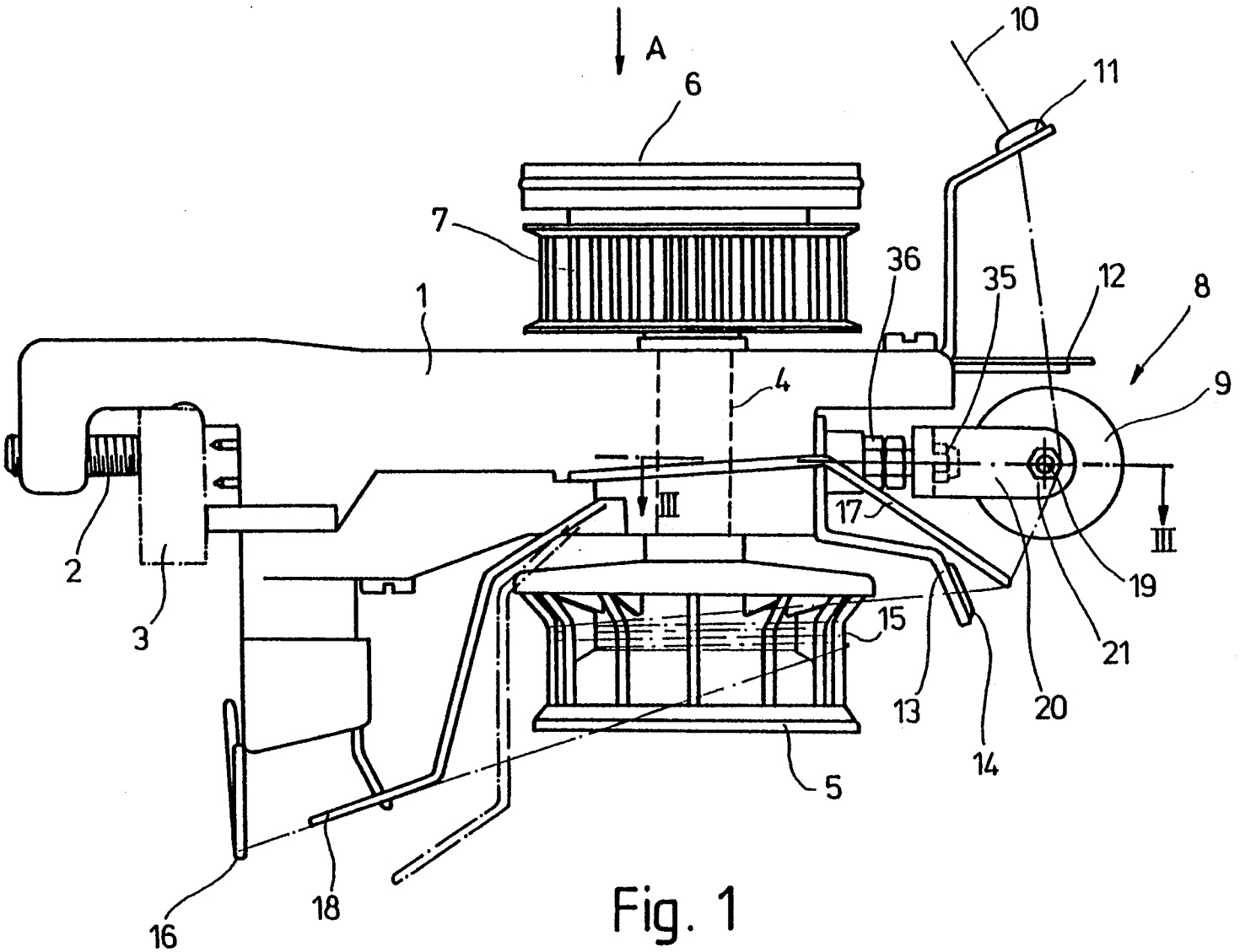
Figure 2:
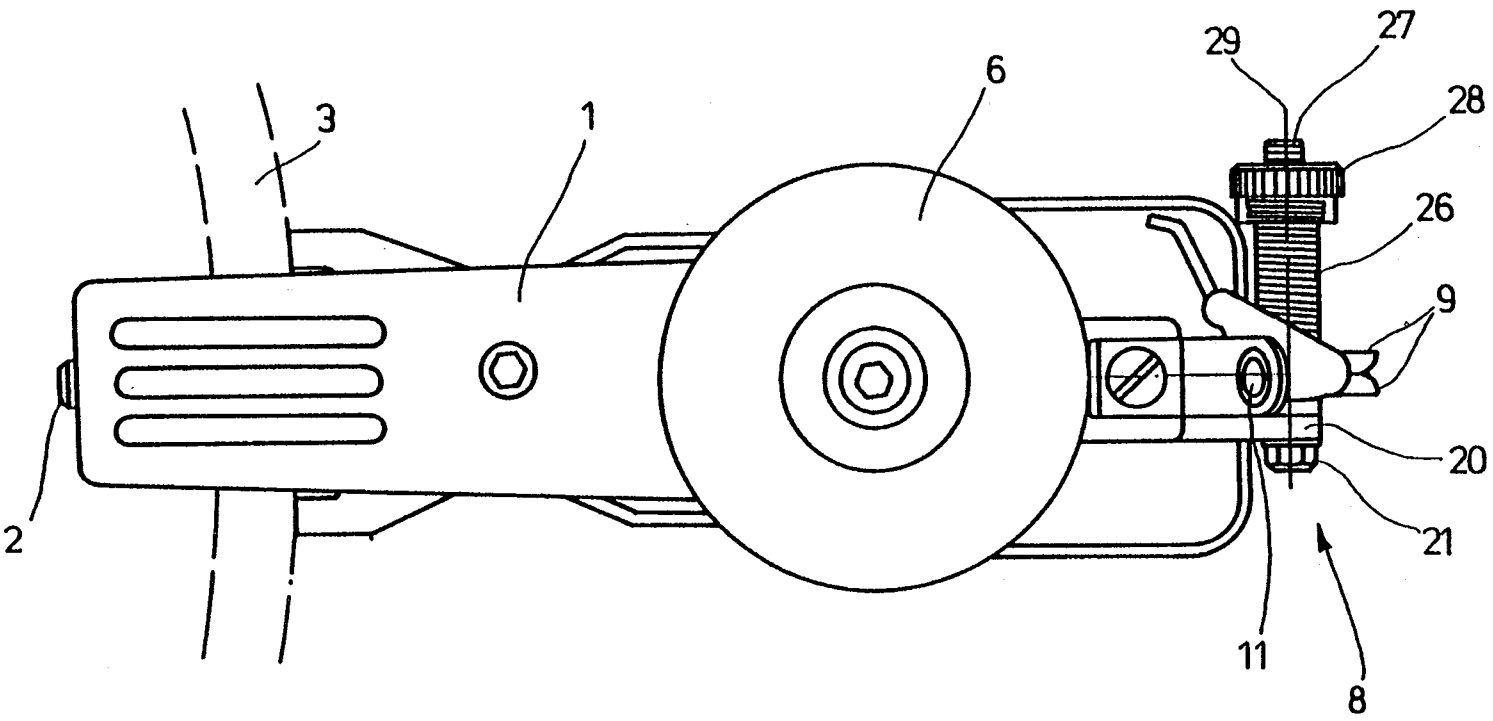

The thread supplying device illustrated in FIGS. 1 and 2 is known in its basic design. It comprises a holder 1 which can be attached by a clamping screw 2 to a carrier ring indicated at 3 of, for example, a circular knitting machine. Mounted for rotation in the holder 1 is a continuous shaft 4 which is oriented in the vertical direction when the holder 1 is mounted in the operating position. At its one end, the shaft 4 is rotationally fixedly connected to a thread drum 5 in the form of a bar cage arranged below the holder 1. At its top end, the shaft 4 carries a toothed belt pulley 7 which can be rotationally fixedly coupled via a coupling 86 and via which the thread drum 5 can be made to rotate from an endless toothed belt not illustrated herein.

A plate-type thread brake 8 is arranged on the end face of the holder 1 opposite the clamping screw 2. The plate-type thread brake 8 comprises two substantially disc-shaped brake plates 9 of identical design between which the thread indicated at 10 runs through. The thread runs from a thread bobbin, not illustrated herein, through a thread eyelet 11 attached to the holder 1, a knot catcher 12 and the thread brake 8 to a thread intake eyelet 14 which is attached to the holder 1 via an angular part 13 and from which the thread 10 runs onto the thread drum 5 on which it forms a storage coil 15 and from which it runs via a thread takeoff eyelet 16 similarly provided on the holder 1 to the thread consuming point. Thread feeler arms 17, 18 each mounted for pivotal motion about a horizontal pivot axis on the holder 1 and connected to thread breakage stopping devices arranged in the holder 1 monitor the course of the thread on the intake and takeoff sides of the thread drum 5.

Figure 3:
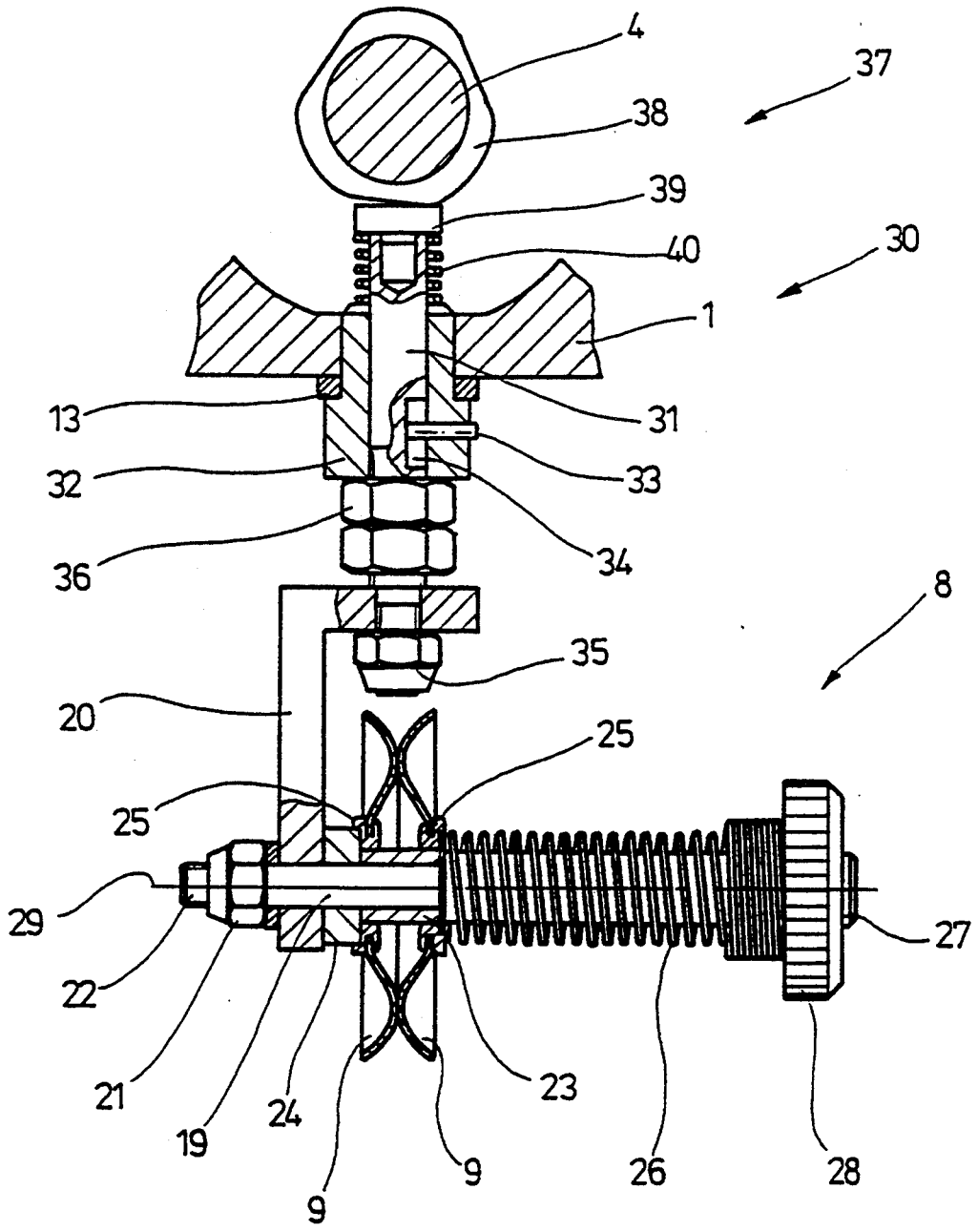

As is apparent, in particular from FIG. 3, the thread brake 8 comprises a guide bolt 19 which forms a guide element and is attached at one end to holding means in the form of an angled part 20 by a nut 21. The nut 21 is screwed onto a threaded part 22 of the guide bolt 19 on which an intermediate bushing 23 made of ceramic material is placed on the side facing away from the angled part 20. The intermediate bushing 23 is supported at one end against an annular shoulder on the guide bolt 19 and at the other end via an annular disc 24 of larger diameter against the angled part 20. The two brake plates 9 are mounted on the intermediate bushing 23 by means of plastic bushings 25 for slight rotation and axial displacement with a certain radial play. They are pressed against each other elastically in the axial direction by a compression spring 26 which is placed on the guide bolt 19. The pressing force of the compression spring 26 acting on the brake plates 9 is selectively adjustable by a regulating nut 28 which is screwed onto a threaded part 27 of the guide bolt 19.

In accordance with a feature of the invention, the thread brake 8 described hereinabove can be made to oscillate with its brake plates 9, the guide bolt 19 and the angled part 20 forming the holding means. The amplitude of the oscillations is mainly oriented at a right angle to the common bearing axis 29 of the two brake plates 9 which is formed by the guide bolt 19. An oscillation generating device designated in its entirety 30 in FIG. 3 is provided for this purpose. The thread brake 8 is directly connected to this oscillation generating device.

The oscillation generating device 30 comprises a reciprocating member in the form of a driver rod 31 which is axially displaceably but non-rotatably mounted in a bearing bush 32. The bearing bush 32, for its part, is inserted in the associated end wall of the holder constituting a housing. The bearing bush 32 simultaneously supports the angular part 13 carrying the intake eyelet 14. it is provided with a radial pin 33 which engages a corresponding longitudinal groove 34 in the driver rod 31 and prevents it from rotating.

The thread brake 8 is screwed onto one end of the driver rod 31 by a nut 35 via the angled part 20. The driver rod 31 carries two counter nuts 36 which are screwed on in the area between the angled part 20 and the bearing bush 32 and form an adjustable stop for delimiting the reciprocating stroke of the driver rod 31.

The driver rod 31 is driven from the shaft 4 via a cam motion transfer, or drive cam element, in this case, in the form of a cam disc 38 with three surfaces which is rotationally fixedly positioned on the shaft 4. The driver rod 31 is supported against the cam surface of the cam disc 38 with a wear cap 39 interposed at the end face between these. A readjusting spring 40 arranged between the wear cap 39 and the bearing bush 32 prestresses the driver rod 31 in the direction towards the cam disc 38 such that the driver rod 31 is held in permanent engagement with the cam surface of the cam disc 38 via the wear cap 39.

During operation of the thread supplying device, the shaft 4 rotates at a rotational speed of from approximately 400 to approximately 4000 r.p.m. and generates in dependence upon the number of cam surfaces on the cam disc 38 a reciprocating oscillatory motion of the driver rod 31 which, taking into account the natural frequency of the entire moved assembly, usually lies in the range of from 45 to 150 Hz. This oscillatory motion is transmitted via the angled part 20 to the thread brake 8 with the result that the brake plates 9 which are mounted on the intermediate bushing 23 for free movement to a limited extent execute a constant vibratory motion, the amplitudes of which are mainly oriented transversely to the bearing axis 29. Since, as is apparent from FIG. 1, the thread 10 passes eccentrically between the brake plates 9, these are made to rotate while the thread is running, which together with the vibration transmitted via the driver rod 31 as explained hereinabove results in an effective self-cleaning of the thread brake 8.

Figure 4:
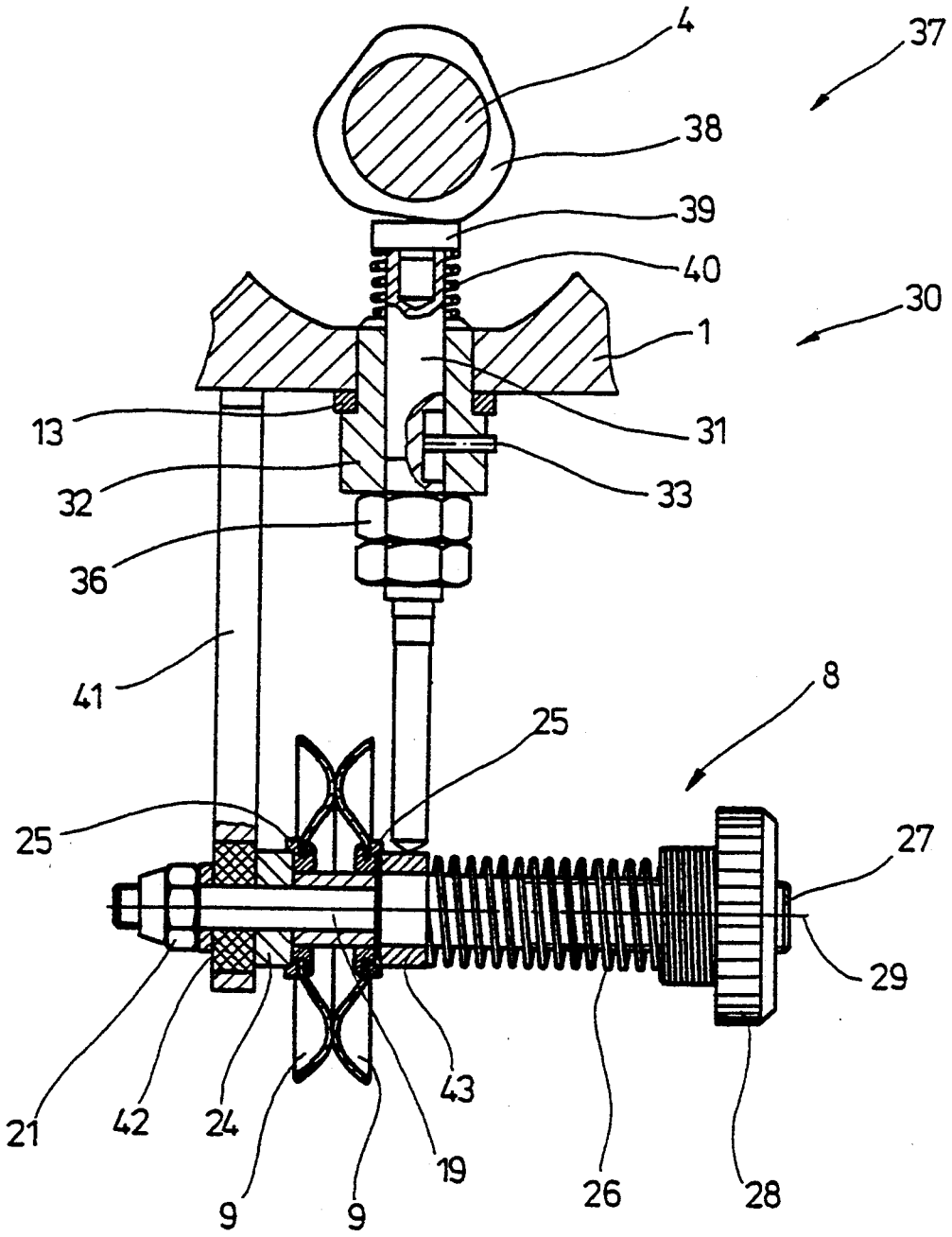
Figure 5:
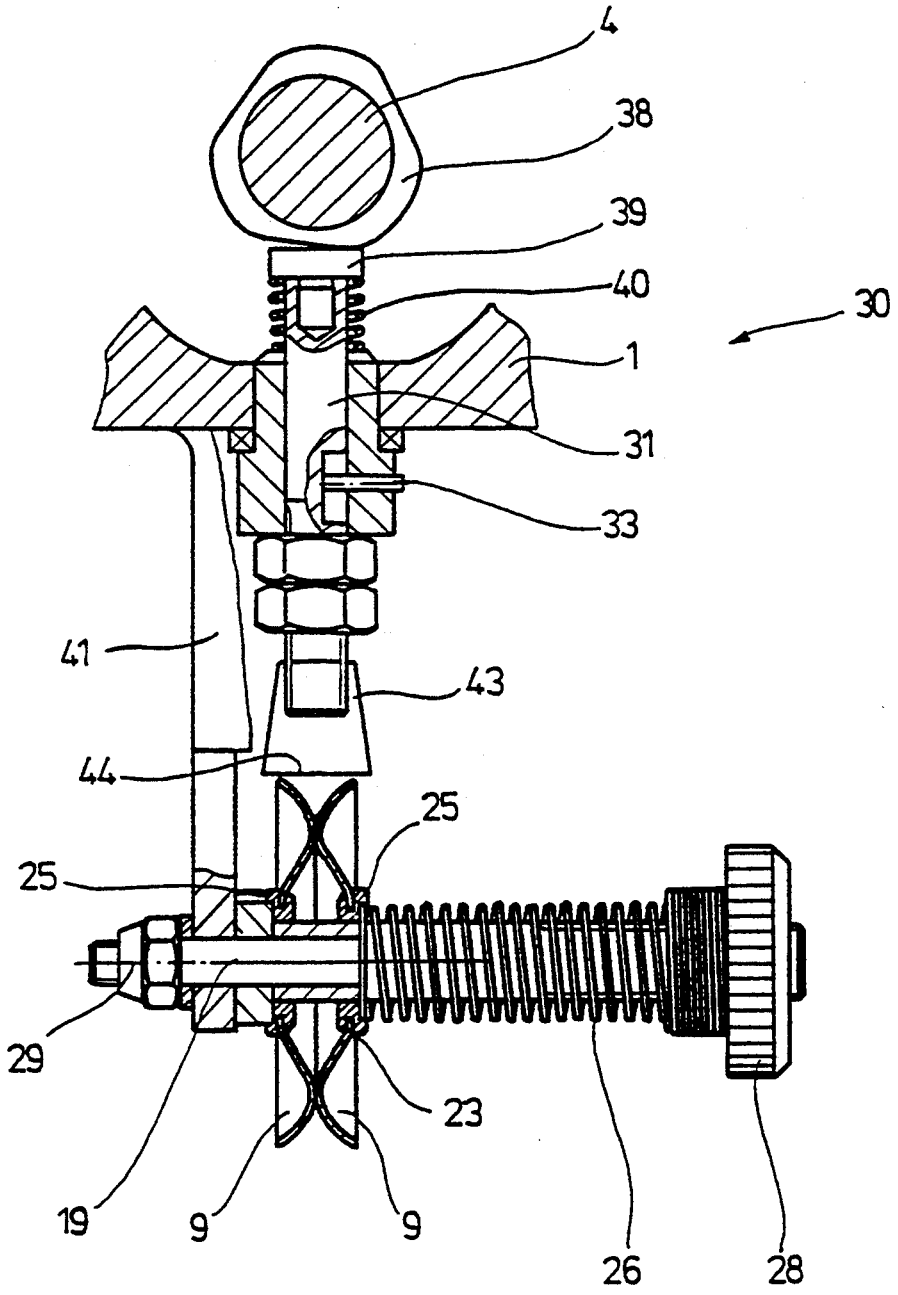

In the embodiment discussed hereinabove, the thread brake 8 is directly attached to the driver rod 31 via the angled part 20 without any further connection to the holder 1 of the thread supplying device. Depending on the given conditions of use of the thread brake 8, it may sometimes prove expedient to mount or support the guide bolt 19 independently of the member generating the oscillations of the brake plates 9. Examples of this are shown in FIGS. 4 and 5.

In these Figures, parts identical with those of the embodiment described with reference to FIGS. 1 to 3 bear the same reference numerals and are not explained again. With reference to FIG. 4:

The guide bolt 19 is mounted on the housing 1 by means of a bearing bracket 41 which is rigidly connected to the housing 1. The bearing bracket 41 contains a ring-shaped, rubber-elastic bearing part 42 which is, for example, vulcanized therein and to which the guide bolt 19 is screwed in such a way that it is held elastically moveable in its bearing point. On the rigid guide bolt 19 consisting of steel, there is positioned in a slightly displaceable manner, for example, between the brake discs 9 and the compression spring 26 a pressure bushing 43 against the outer circumferential surface of which there rests the driver rod 31 which is rounded off at the end and correspondingly lengthened.

Hence the reciprocating oscillatory motion of the driver rod 31 is directly transmitted to the guide bolt 19 and the brake plates 9 while the rigid bearing bracket 41 itself remains vibration-free. In this case, the guide bolt 19 and the brake plates 9 execute an oscillatory motion which is mainly oriented transversely to the bearing axis 29 but owing to the tilting motion which occurs with centre of motion in the bearing point also contains longitudinally oriented components.

The embodiments described hereinabove according to both FIGS. 3 and 4 could also be modified in such a way that the guide bolt 19 itself is made of an elastic material, for example, a suitable plastic material, which enables it to execute a bending oscillation. In this case, the rubber-elastic bearing element 42 in FIG. 4 could, in the given circumstances, be dispensed with.

The embodiment illustrated in FIG. 5 differs from that according to FIG. 4 in that the oscillation generating device 30 is designed to act directly on the brake plates 9. For this purpose, the driver rod 31 is arranged with its axis lying in the centre plane between the two brake plates 9. It carries at its end an approximately frustoconical-shaped drive member 43 with a flat base surface 44 approximately parallel to the bearing axis 29. The dimensions of the longitudinal extent of the base surface 44 in the direction of the bearing axis 29 are such that it engages over the two brake plates 9 on both sides in the manner apparent from FIG. 5.

The brake plates 9 are mounted with radial play on the intermediate bushing 23. The dimensions of their radial spacing from the base surface 44 of the drive element 43 are such that during the reciprocating motion of the driver rod 31 the drive element 43 periodically engages the circumference of the brake plates 9 and thereby sets these in oscillatory motions, the amplitudes of which are oriented substantially at a right angle to the bearing axis 9.

In this case, the guide bolt 19 is rigidly screwed to the bearing bracket 41. In principle, embodiments are, however, also conceivable in which the guide bolt 19 is mounted via a rubber-elastic bearing part 42 in accordance with FIG. 3. The guide bolt 29 may, in the given circumstances, also consist of an elastic material.

Depending on the purpose for which the thread brake is used, the compression spring 26 can also be replaced by other load means such as an electromagnet or means which are acted upon by the force of gravity. Examples herefor will now be explained with reference to the embodiments according to FIGS. 6 to 11.

When describing these further embodiments of the thread brake, parts identical with those of the embodiments described with reference to FIGS. 1 to 4 bear the same reference numerals and are not explained again. The details of the thread supplying device and of the vibration or oscillation generating device 30, as they are illustrated in FIGS. 1 to 3, are illustrated in FIGS. 6 to 14 only to such an extent as it is necessary for properly understanding the embodiments of the thread brake that are associated therewith. Apart from that, the thread supplying device itself and the oscillation generating device 30 are designed according to FIGS. 1 to 3; therefore, reference is made to the explanations already given in connection with these Figures.

While with the embodiments of the thread brake that have been explained with reference to FIGS. 1 to 5 the two brake discs 9 are supported on an elongated guide element in the form of the guide bolt 19, defining the common bearing axis 29, the embodiments of the thread brake that are illustrated in FIGS. 6 to 14 use a guide element 190 that makes it possible to dispense with a guide bolt 19 transversing the brake discs or plates 9.

Practical experience has shown that when braking yarns with a strong tendency of shedding fluff, additional measures should be taken in order to avoid undesirable depositions of fluff and lint which depositions would impair the proper function of the thread brake after a certain time of operation.

When braking yarns showing a strong tendency for fluffing, fluff or lint depositions may build up in the vicinity of the guide bolt 19 or of the intermediate bushing supported thereon (FIG. 3). The reason for this undesirable fluff build-up is seen in the fact that the path of the running thread 10 is angled in this zone, as it is shown in FIG. 1. Any deposition of fluff or lint around the intermediate bushing 23, however, will sooner or later lead to a complete blocking of the rotational movement of the brake discs or plates 9.

In order to avoid such undesirable depositions of fluff or lint in the central zone of the brake plates 9, no guide bolt 19 is used with the embodiments of the thread brake that will be explained below with reference to FIGS. 6 to 14. The central area of the brake plates is left void and, therefore, no fluff or lint can be deposited in this area.

Figure 6:
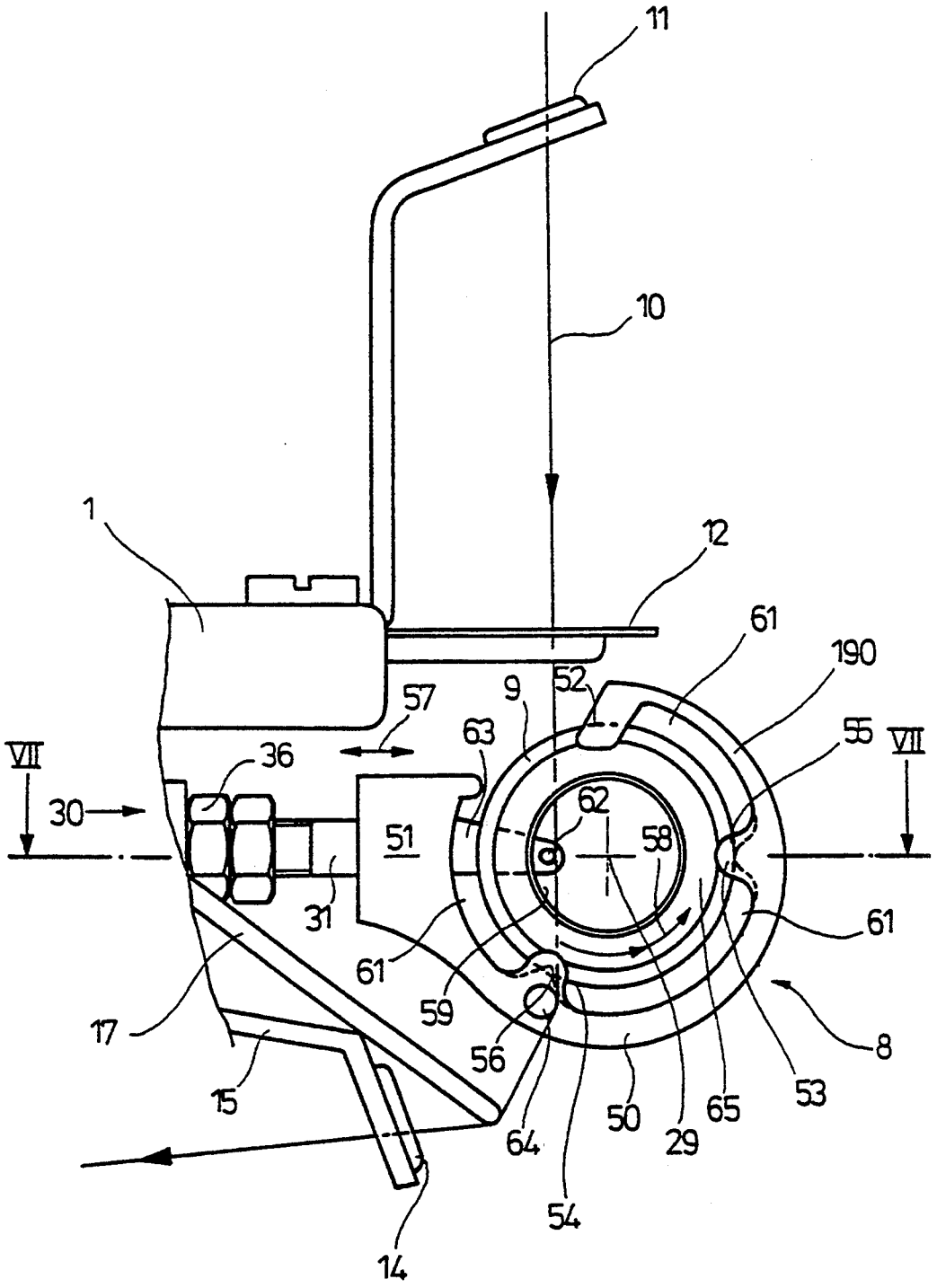
Figure 7:
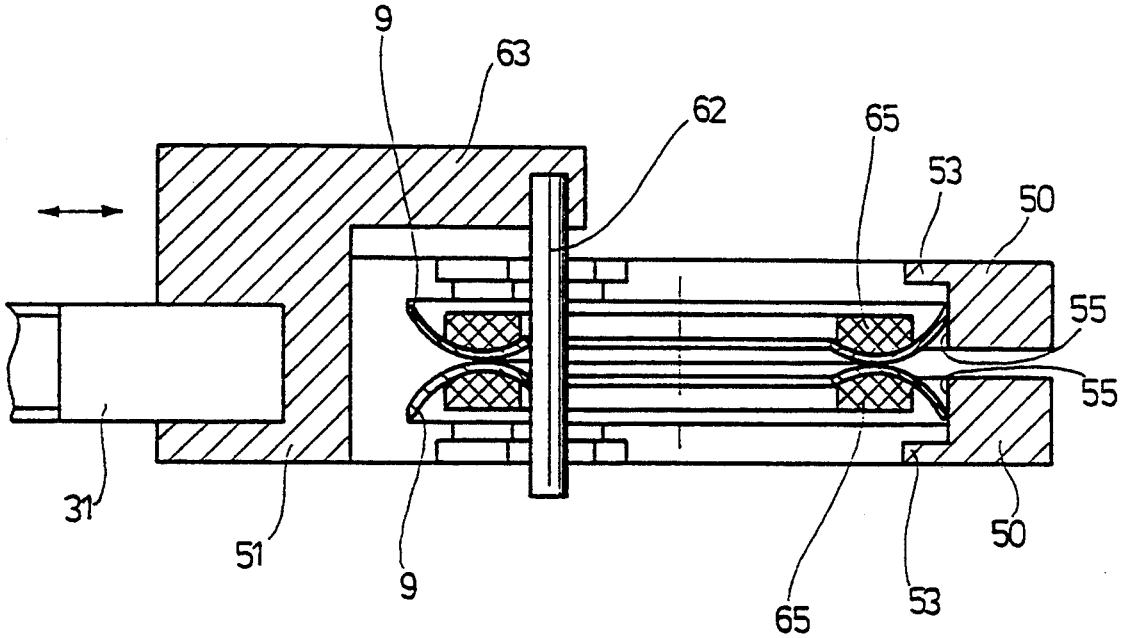

A first embodiment of a thread brake having the before quoted features is illustrated in FIGS. 6 and 7. The guide element 190 for the two brake plates 9 that are arranged on the common bearing axis 29 in a concentric relation to one another is affixed to the driver rod 31 of the oscillation generating device 30 (see FIG. 3). The guide element 190 is designed to partially embrace over an angular area of about 300° the circumference of the two brake plates 9. It comprises two bearing elements 50, having the general form of half-shells or semi-circular supporting elements which are arranged in an axial distance from one another (FIG. 7) and in a parallel relationship to one another. At their ends the two bearing elements 50 are integrally connected to a supporting block 51 that is screwed onto the driver rod 31. Each of the curved bearing elements 50 is provided with three integral bearing lugs 52, 53, 54 that are radially and inwardly projecting and that are distributed in about similar angular distances along the circumference of the bearing element 50. The bearing lug 53 is located approximately on the axis of the driver rod 31. As it is to be seen from FIG. 7, the bearing lugs 52 to 54 form discrete, localized, lateral supporting points for the two brake plates 9, thereby holding these brake plates 9 in an undetachable way within the guide element 190. On their circumference the two brake plates 9 are radially supported on two bearing points or locations 55, 56 that are provided in the area of the bearing lugs 53, 54.

In the guide element 190 the two brake plates 9 are supported freely rotatably around the common bearing axis 29; in radial direction they rest only on the two bearing points 55, 56 of which the bearing point 55 is located about on the axis of the driver rod 31, while the second bearing point 56 engages the circumference of the brake plates 9 in an area below the common bearing axis 29 (FIG. 6). Because of this particular arrangement the brake plates 9 will be frictionally driven by a driving force tending to rotate the brake plates 9 in a first sense of rotation (in the counter clock sense) that is indicated by an arrow 58 in FIG. 6, when the driver rod 31 will make a to-and-fro oscillating movement, as it is indicated with a double-arrow 57.

The two brake plates that are supported on their circumference only on two discrete bearing points 55, 56 and that are laterally held with axial tolerances by the bearing lugs 52 to 54, are each provided with a throughgoing circular central opening 59 in order to avoid any fluff depositions in this area.

Usually, the guide element 190 will be made of plastics; as it is evidenced e.g. by FIG. 6, free spaces 61 are provided between the bearing lugs 52 to 54. These free spaces 61 extend over a major portion of the circumference of the brake plates 9 and enhance fluff removal.

In a lateral distance and parallel to the common bearing axis 29, a transverse pin 62 extends through the openings 59 of the brake plates 9. The transverse pin 62 is made of ceramic material and affixed to an integral supporting arm 63 of the guide element 190. It prevents the thread 10 from unintentionally being thrown out of the braking or clamping zone between the two brake plates 9.

Adjacent to the lower bearing lug 54 a thread deviating bolt 64 is provided that is oriented parallel to the common bearing axis 29 and that is used for diverting the thread 10 emerging from the thread brake 8 towards the thread eyelet 14, as it is shown in FIG. 6. The thread deviating bolt 64 is also made of ceramic material.

FIG. 6 shows that because of the particular locations of the thread eyelet 11, of the transverse pin 62 and of the yarn deviating bolt 64 a thread path is defined on which the thread 10 that enters between the brake plates 9 in the direction of the arrow (lefthand side of FIG. 6) runs in a lateral distance from the common bearing axis 29 before it leaves the space between the two brake plates 9 in an area that is close to the lower bearing point 56. Because of this eccentrically arranged thread path, the running thread 10 will frictionally drive the brake plates 9 or, in other words, the two brake plates 9 will be subjected to a torque that is effective in the same sense of rotation (as indicated by an arrow 58) as the torque that is frictionally transmitted via the bearing points of the guide element 190 to the circumference of the brake plates 9 and that is generated by the oscillating movement of the driving rod 31 of the oscillation generating device 30.

In the absence of the guide bolt 19 of the embodiment according to FIG. 3, the compression spring 26 is dispensed with too. The two braking plates 9 are pressed against one another by magnetic forces in an axial direction. To achieve this, annular permanent magnets 65 of opposite polarities are affixed to the outside of the brake plates 9, which plates are made of a nonmagnetic material; each of them is in the form of a half-shell the shape of which is clearly to be seen from FIG. 7.

Figure 8:
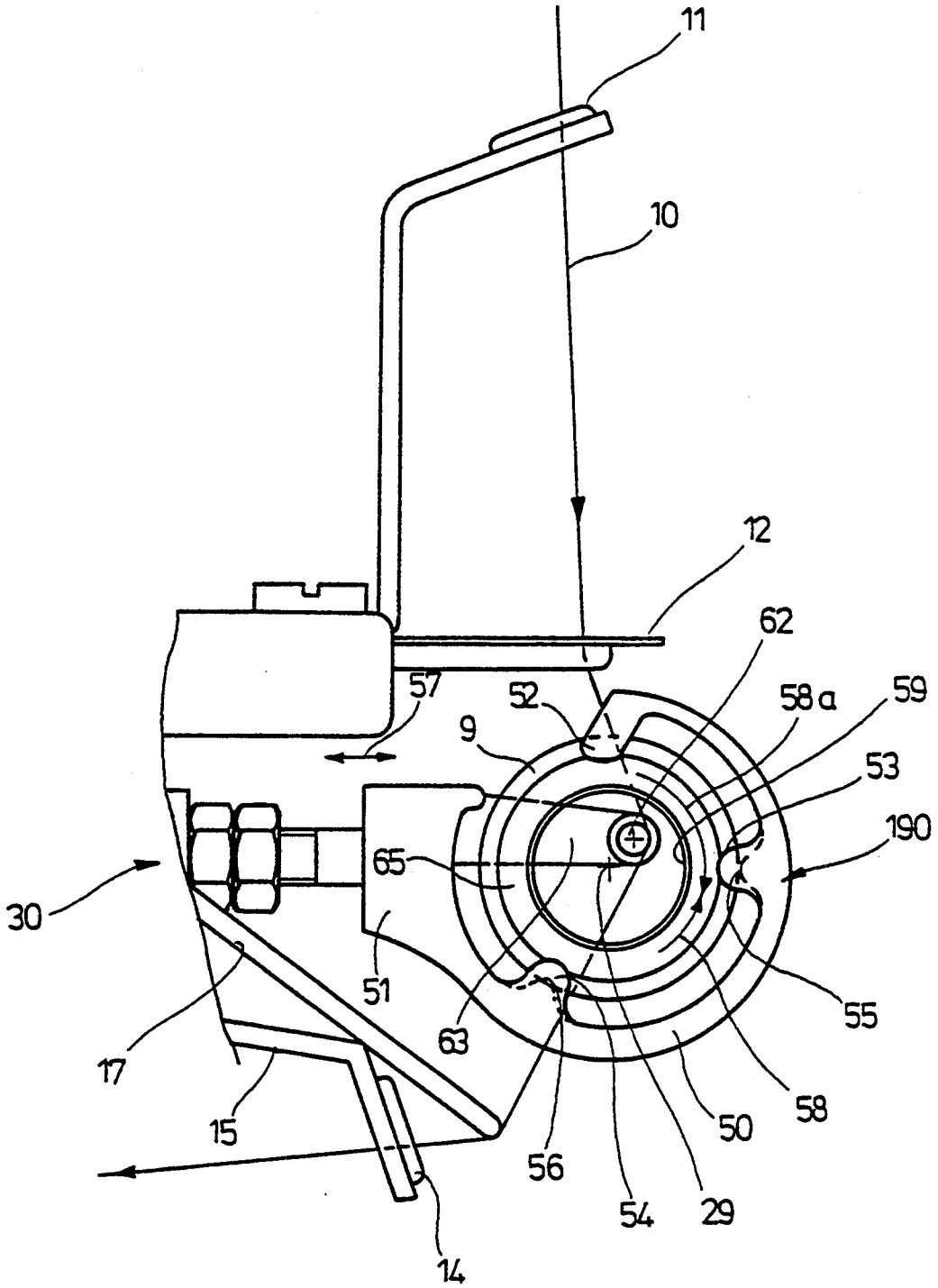

The embodiment that is shown in FIG. 8 is similar to the embodiment of the thread brake 8 that has been explained with reference to FIGS. 6, 7. The only difference is that the transverse pin 62 is now arranged within the openings 59 on the opposite, e.g. the righthand side of the common bearing axis 29. The thread 10 that passes on an eccentric path between the brake plates 9 will, therefore, exert on the brake plates 9 a torque in a direction that is indicated by an arrow 58*a* and that is directed in the opposite direction of the torque that is generated with the embodiment of FIG. 6.

In this way the resulting torque to which the brake plates are subjected and that is generated by the running thread 10 on the one side and by the oscillating vibration movement of the driving rod 31 on the other side is diminshed resulting in a corresponding reduction of the rotational speed of the brake plates 9 around the common bearing axis 29. This embodiment is preferable in cases where the rotational speed of the brake plates 9 would otherwise be excessive resulting in the thread 10 being thrown out of the space between the two brake plates 9.

Figure 9:
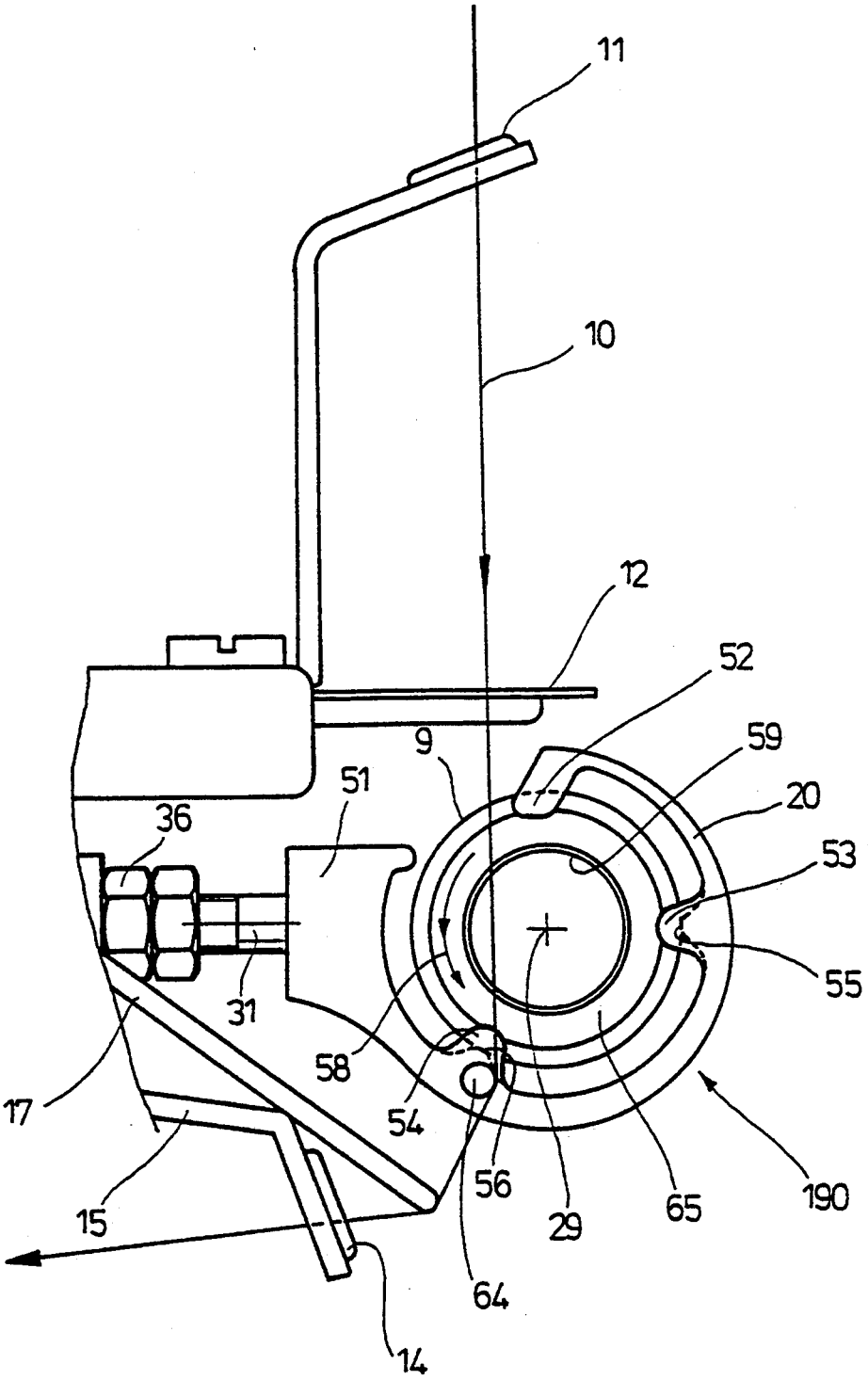

It should be mentioned that the transverse pin 62 can be dispensed with. Embodiments of the thread brake 8 that are designed in this way are illustrated in FIGS. 9 to 14:

The embodiment according to FIG. 9 is very similar to the embodiments that have been explained in connection with FIGS. 6, 8; similar elements have, therefore, the same reference numerals and are not explained anymore.

The thread 10 coming from the upper side and entering the space between the two brake plates 9 from their circumference is passed through the opening 59 on one side of the guide element 190, when leaving the space between the two brake plates 9; on its further way the thread 10 then passes on the outer side of the guide element 190 via the thread deviating bolt 64 to the thread input eyelet 14. When passing between the two brake plates 9, the thread frictionally engages the two brake plates 9, thereby subjecting the two brake plates 9 to a torque that is effective to drive the brake plates 9 in the sense of rotation of the arrow 58, e.g. in the same sense of rotation as the brake plates 9 are already driven by the torque that is generated by the oscillation generating device 30.

Figure 10:
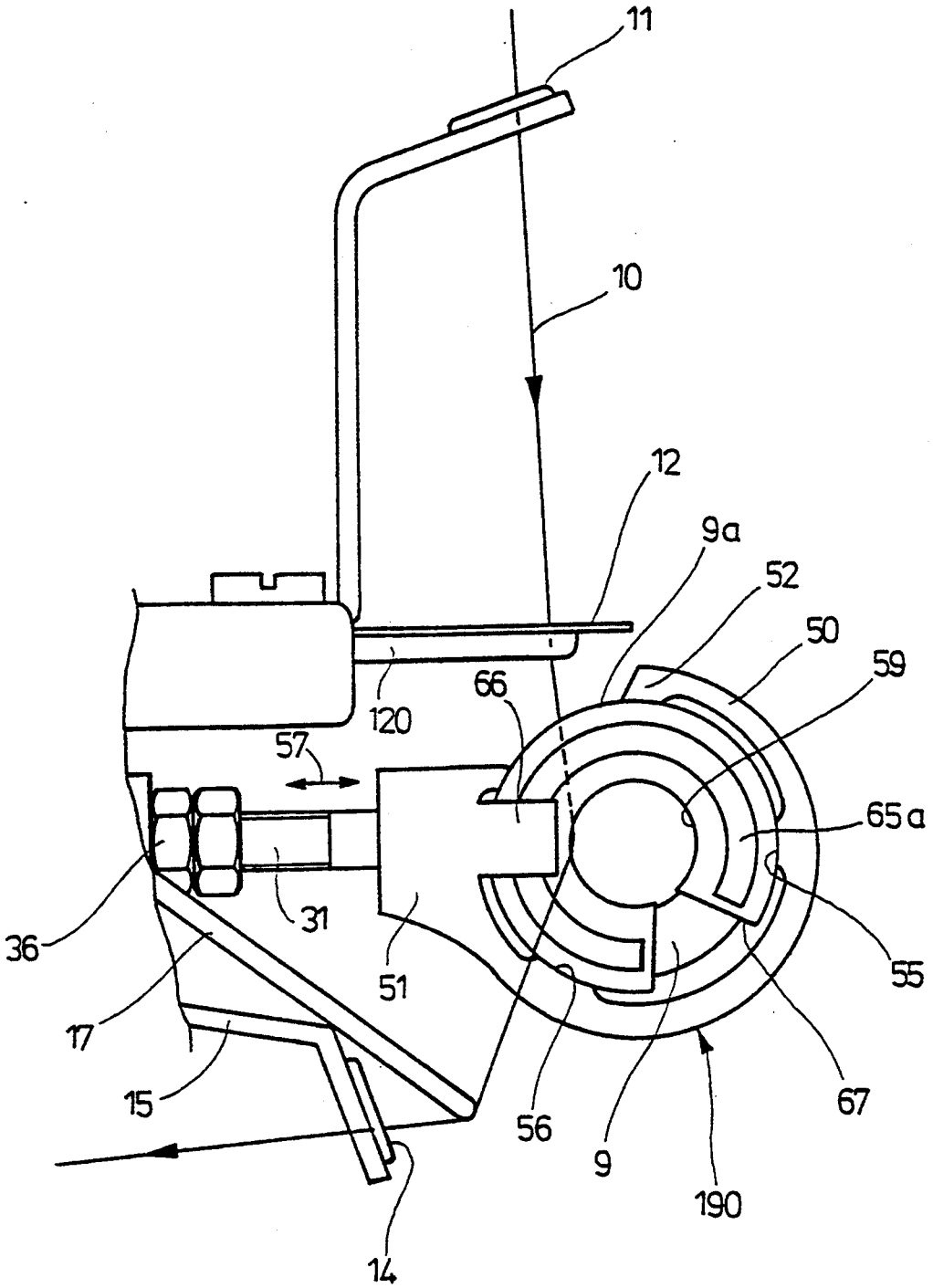
Figure 11:
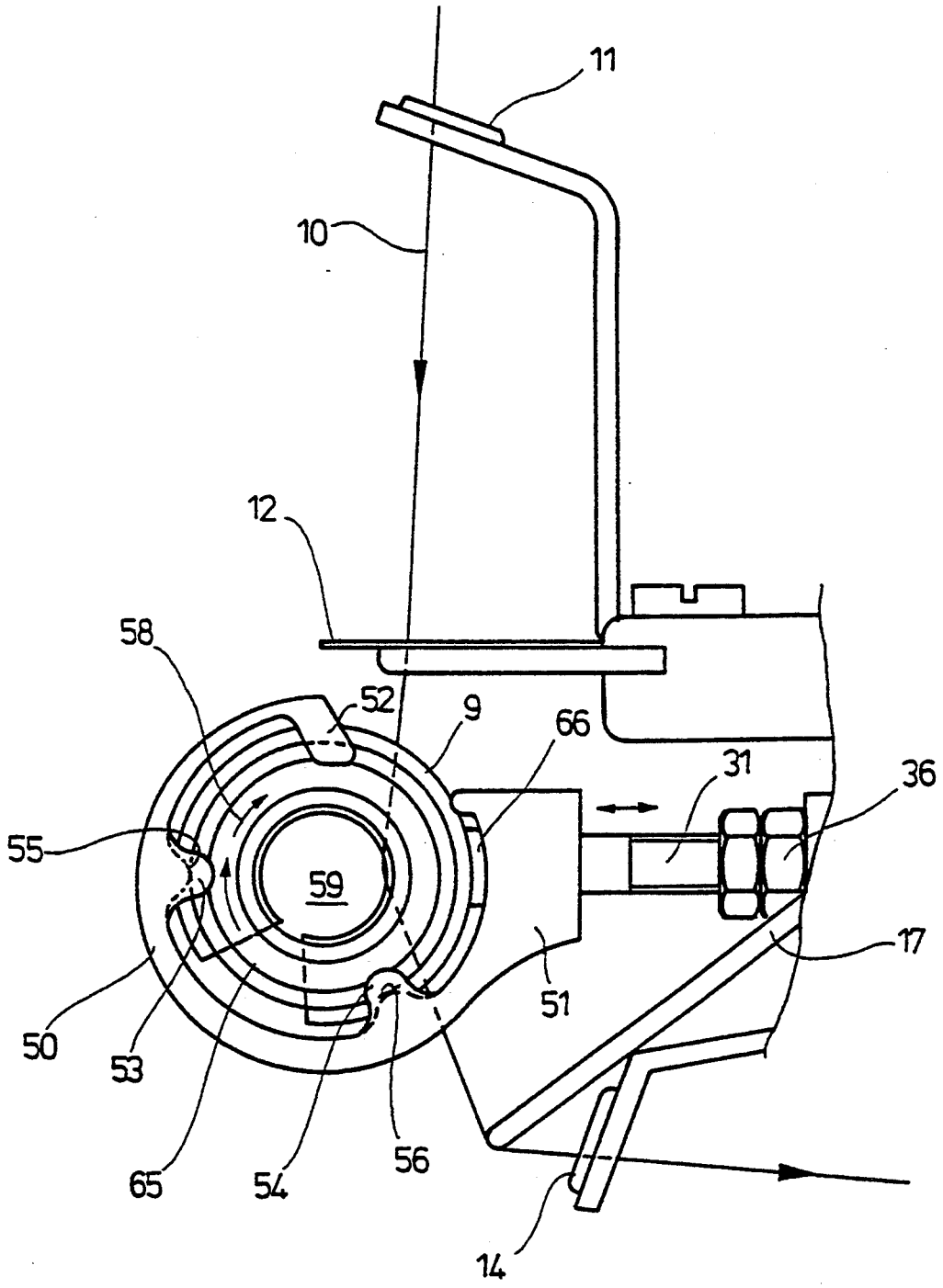

In order to facilitate threading of the thread 10 in the annular brake plates 9 of the thread brake according to FIG. 9, provisions can be made which will now be explained on two embodiments of thread brakes that are illustrated in FIGS. 10 to 14:

Of the two brake plates 9 of the embodiment according to FIGS. 10, 11 one brake plate **9*a* is stationary and affixed to the supporting block 51 of the guide element 190. For this reason, the guide element 190 is provided with an integral protruding arm 66 on which of the annular brake plate 9*a* is fastened. At a location that is remote from the thread path, as it is illustrated in FIGS. 10, 11, this brake plate 9*a* is provided with the V-shaped thread slot 67 that leads from the circumference of the brake plate into its opening 59**.

The second brake plate 9 is, similar to the embodiments according to FIGS. 6 to 9, freely rotatably supported on its circumference. Once again the two bearing points have the reference numerals 55, 56. The bearing lugs 52, 53, 54 provide for the lateral support of this brake plate 9.

All elements that are similar to corresponding elements of previously explained embodiments have the same reference numerals and are not explained anymore.

For threading the thread 10 is drawn beyond the knot catcher 12 and a yarn guide hook 120 associated therewith into an area below the thread brake 8. Without releasing the thread, the thread is then passed in a radial direction from one side (the righthand side in FIG. 7) through the space between the two bearing elements 50 and into the space between the two brake plates 9, **9*a*. When moving the thread 10 in this way, the thread 10 is automatically laterally passed out of the opening 59 of the stationary brake plate 9*a*, and subsequently the thread 10 can be threaded through the thread intake eyelet 14. The thread 10 leaves the opening 59 in a manner as it is shown in FIG. 10, thereby passing over the rounded edge of the opening 59. In order to prevent the thread 10 from cutting into the stationary brake plate 9*a*, the edge of the opening 59** is, with a preferred embodiment, made of a ceramic material or of a material bearing a wear-resistant coating.

The two brake plates 9, **9*a* are biased in an axial direction towards one another by annular permanent magnets 65 for braking the thread 10 passing between the brake plates 9, 9*a*. The arrangement is similar to FIG. 6, the annular permanent magnet 65*a* of the stationary brake plate 9*a* being provided with a cut-out in order to accommodate the threading slot 67**.

It should be noted that the drive torques that are exerted on the rotationally supported brake plate 9 by the running thread 10 and by the oscillation generating device 30 are effective in the same sense of rotation (in the counter-clock sense of FIG. 10).

Figure 12:
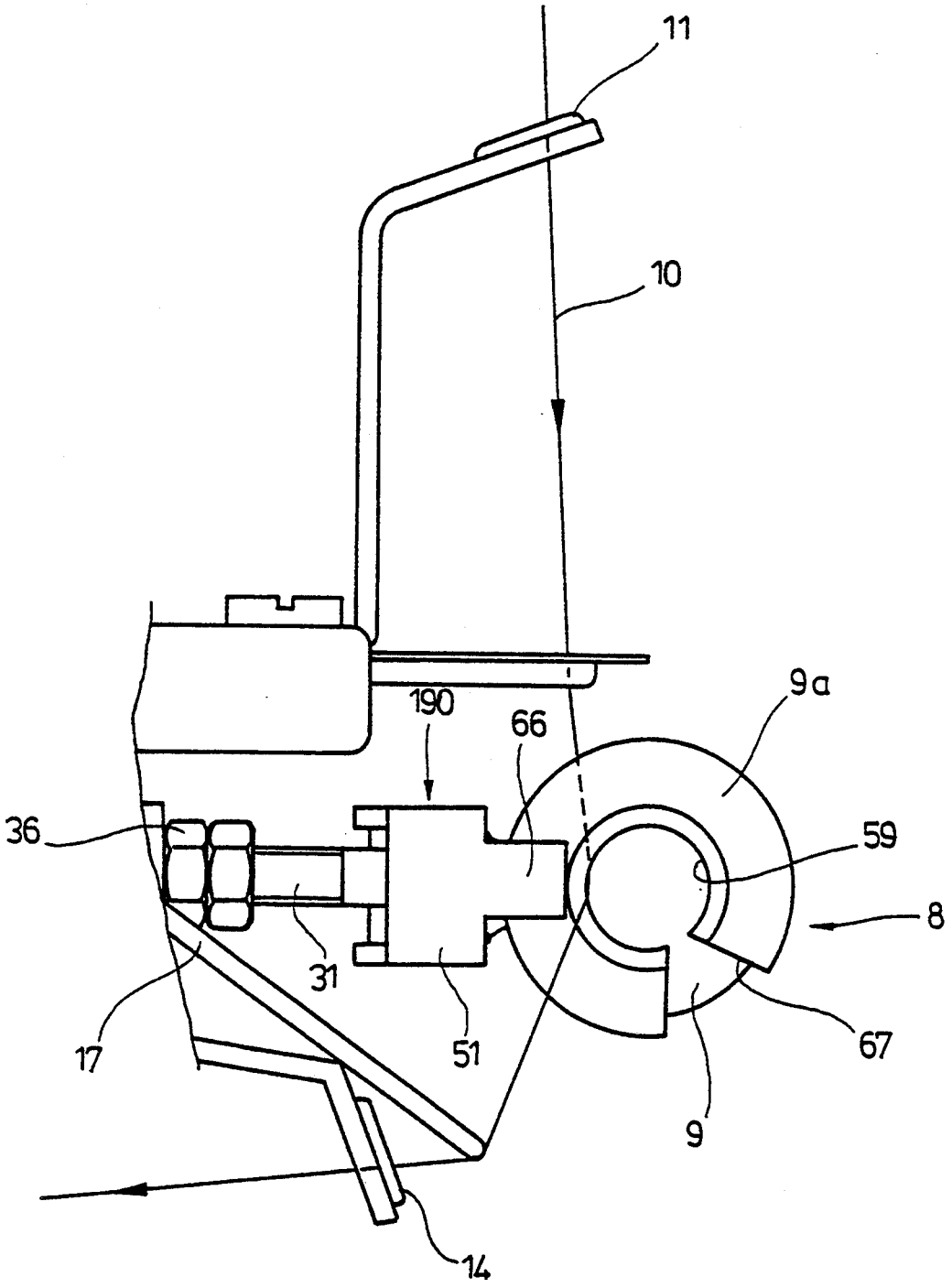
Figure 13:
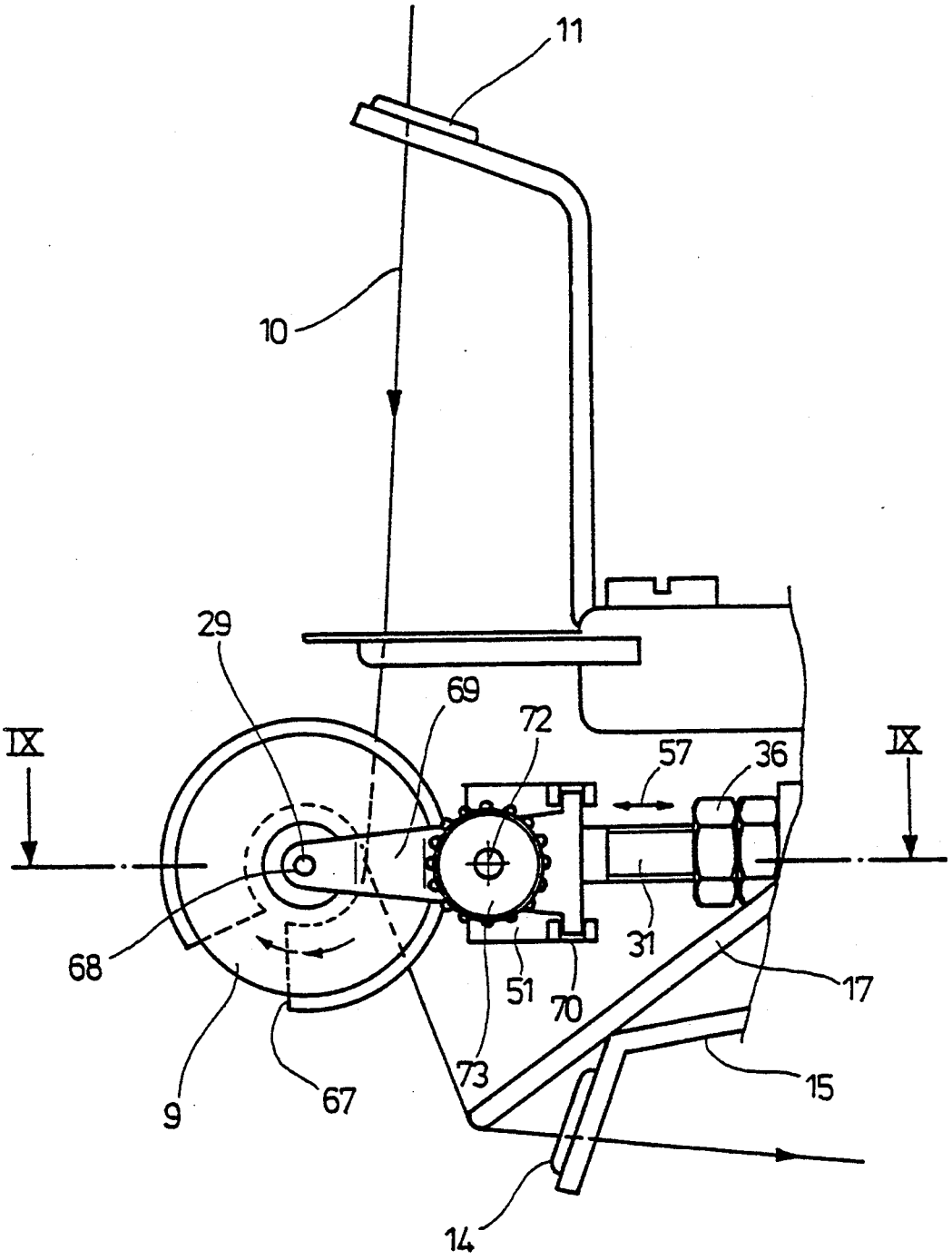
Figure 14:
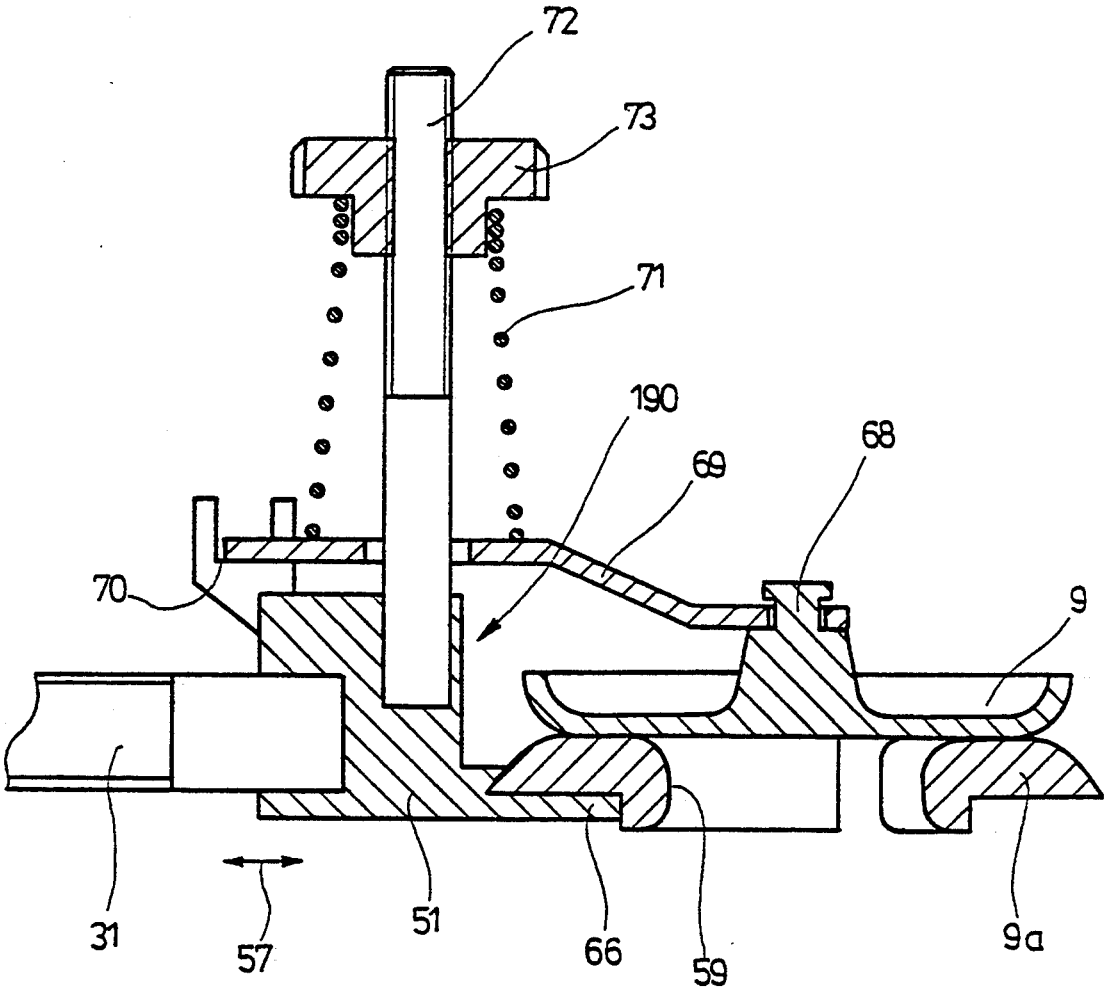

The embodiment that is illustrated in FIGS. 12 to 14 is provided similar to the embodiment of FIGS. 10, 11 with a stationary brake plate **9*a* which is provided with a threading slot 67 that is located remote from the thread path (see FIGS. 12, 13**). All elements that are similar to elements of embodiments that have already been explained have the same reference numerals and are not explained anymore.

The stationary brake plate **9*a* is annular; it is provided with a through-going central opening 59. Threading of the thread 10 is done, as it has already been explained with reference to FIGS. 10, 11**.

Deviating from the embodiment according to FIGS. 10, 11, the second rotationally supported brake plate 9 is not provided with a central opening 59, but it is closed or impervious in its central area (see FIG. 14). The brake plate 9 is provided with an integral cylindrical bearing pin 68 that defines the common bearing axis 29, and it is by means of this bearing pin 68 that this brake plate 9 is freely rotationally supported on an elongate bracket 69. At its opposite end the bracket 69 is pivotably supported via a bearing fork 60 on the supporting block 51 of the guide element 190. It is biased by a compression spring 61 that is mounted on a threaded bolt 72 that is affixed to the supporting block 51. For adjusting the bias of the compression spring 71, an adjusting screw 73 is provided. The braking force that is exerted by the brake plates 9, **9*a* on the thread 10 passing therebetween can thus be controlled by turning the adjusting screw 72**.

What is claimed is:

1. A thread brake having two essentially disc-shaped or plate-shaped brake elements (9, **9*a***);

loading means (26, 65) for resiliently pressing the brake elements (9) against each other and to permit at least one thread (10) passed between said brake elements to be braked;

bearing means (19, 23, 25; 190) for mounting said brake elements on a common bearing axis;

oscillatory motion generating means (30) coupled to said brake elements (9) and oscillating said brake elements in a direction which is oriented substantially transversely to said bearing axis (29) for imparting oscillatory motions essentially transversely to said bearing axis (29) to said brake elements.

2. The thread brake of claim 1, wherein the mounting means (19, 23, 25) for said brake elements (9) comprise an elongated guide element (19) containing said bearing axis; and wherein said brake elements are set in said oscillatory motions jointly with said guide element (19).

3. The thread brake of claim 2, wherein said guide element (19) is rigid.

4. The thread brake of claim 2, wherein said guide element (19) is at least in part elastic.

5. The thread brake of claim 2, further comprising a holding means (20, 41) coupled to said guide element (19).

6. The thread brake of claim 5, wherein the guide element (19) is connected to said holding means (20); and wherein said holding means (20) is coupled to said oscillatory motion generating means (30) for placing said guide element (19) and said brake elements (9) together in said oscillatory motions.

7. The thread brake of claim 5, wherein said oscillatory motion generating means (30) comprises a driven member (31) which executes a reciprocating motion and is coupled with said brake elements; and wherein said holding means (41) are mounted directly on said driven member (31) executing the reciprocating motion.

8. The thread brake of claim 2, wherein said brake elements (9) are mounted on said guide element (19) with radial play.

9. The thread brake of claim 1, wherein the oscillatory motions have a frequency of approximately 40 to 500 Hz.

10. The thread brake of claim 1, wherein said oscillatory motion generating means (30) comprises a driven member (31) which executes a reciprocating motion and is coupled with said brake elements.

11. The thread brake of claim 10, wherein said driven member (31) executes a reciprocating motion and engages the circumference of at least one of said brake elements (9).

12. The thread brake of claim 1, in combination with a thread supplying device having a rotating shaft (4); and wherein said driven member (31) executing the reciprocating motion is operatively coupled with said shaft (4) via a reciprocating drive mechanism (37) generating this motion.

13. The thread brake of claim 12, wherein said drive mechanism is a cam drive mechanism (37) having a cam element (38) which is seated on said shaft (4) and a cam surface with which said driven member (31) is held in contact.

14. The thread brake of claim 1, wherein said oscillatory motion generating means (30) acts directly on said brake elements (9).

15. The thread brake of claim 1, wherein the bearing means (190) form a guide element and support at least one of said brake elements (9) in the region of at least part of its circumference.

16. The thread brake of claim 15, wherein the guide element (190) at least partially embraces one of the brake elements (9) in its circumferential direction.

17. The thread brake of claim 15, wherein at least one of the brake elements (9) is mounted on the guide element (190) for rotation around the common bearing axis (29).

18. The thread brake of claim 17, wherein said at least one rotationally mounted brake element (9) is radially supported on the guide element (190) on distributed localized bearing points or places (55, 56).

19. The thread brake of claim 17, wherein said at least one rotationally mounted brake element (9) is guided in an axial direction with play on the guide element (190).

20. The thread brake of claim 15, wherein at least one of the brake elements (9*a*) is non-rotationally mounted on the guide element (190).

21. The thread brake of claim 20, wherein said non-rotationally mounted brake element (9*a*) is provided with a threading slot (67) extending from its circumference into a central opening (59) formed therein.

22. The thread brake of claim 21, wherein one of the brake elements (9) is rotationally mounted and is integrally closed in its central area.

23. The thread brake of claim 1, wherein at least one of the brake elements (9, 9*a*) is formed with a central opening (59) passing therethrough.

24. The thread brake of claim 23, wherein said guide element (190) is provided with a thread guide element (62) passing through the opening (59) of the at least one brake element (9).

25. The thread brake of claim 1, wherein at least one brake element (9) is rotatably mounted on the guide element (190) and said at least one brake element is rotatable around said common bearing axis (29) in a first sense of rotation (58) by the oscillatory motion generating means (30).

26. The thread brake of claim 25, wherein said at least one brake element (9) is adapted to be rotated by the thread (10) passing between the two brake elements (9, 9*a*) in a second sense of rotation (58), 58*a*) which is in a sense opposite to the first sense of rotation (58).

27. The thread brake of claim 1, wherein said loading means (65) which press the brake elements (9, 9*a*) against one another in axial direction are magnetic means (65).

* * * * *